United States Patent [19]

Johnson

[11] 3,939,990

[45] Feb. 24, 1976

[54] AUTOMATIC ROUGHNECK

[75] Inventor: Charles R. Johnson, San Pedro, Calif.

[73] Assignee: Global Marine, Inc., Los Angeles, Calif.

[22] Filed: June 13, 1974

[21] Appl. No.: 478,930

[52] U.S. Cl. ..... 214/1 P; 114/.5 D; 214/2.5

[51] Int. Cl.[2] ..... E21B 19/14

[58] Field of Search ..... 214/1 P, 2.5; 114/.5 D; 175/5–10, 85; 166/.5, 98; 212/3

[56] References Cited

UNITED STATES PATENTS

| | | | |
|---|---|---|---|
| 1,621,009 | 3/1927 | Giles | 214/2.5 |
| 3,477,527 | 11/1969 | Koot | 175/85 |
| 3,655,071 | 4/1972 | Langowski | 214/2.5 |

*Primary Examiner*—Frank E. Werner
*Attorney, Agent, or Firm*—Christie, Parker & Hale

[57] ABSTRACT

In conventional oil field operations there are men known as roughnecks whose job it is to receive each new section of pipe from a storage rack, position it on the center line of the rig, and join it to the existing pipe string beneath the rig. The apparatus described herein accomplishes this same function automatically and is capable of handling larger pipes faster than a manned operation. The apparatus also aids in returning a pipe section to the storage area.

The apparatus has a pair of parallel tracks curved in a vertical direction extending laterally from the center line of a hoisting arrangement. A trolley rides on each track with the two trolleys mechanically synchronized to be driven together along the tracks by a hydraulic motor. Each trolley has a pivoted roller jaw for guiding the lower end of the pipe as it is swung into position. The jaws are caused to pivot at the proper location and in the proper direction by cams on the track. The pipe jaws are caused to pivot by the cams to open into a generally U-shaped opening away from the center line position for receiving a pipe and preventing it from swinging towards the center line position. Adjacent the center line position the cams cause the jaws to pivot to a generally O-shaped opening for holding the pipe. After the pipe section has been attached to an existing pipe string the cams open the jaws into a generally U-shaped opening in the opposite direction for clearing the pipe. The automatic roughneck is used for guiding the pipe to its center line stabbing position as pipe is added to a string and towards a lateral position as pipe is removed.

17 Claims, 7 Drawing Figures

AUTOMATIC ROUGHNECK

BACKGROUND

In their search for natural resources men have been directing their attention more and more to the vast ocean regions of the world. Explorations carried out in the deeper parts of the ocean have disclosed rich mineral deposits on the sea bed. Because of the extreme depth at which these deposits occur, for example, in the order of 3 or 4 miles below the ocean surface, economic mining and technologically feasible means for recovery of these mineral deposits has presented formidable problems. Large scale mining operations require use of very heavy equipment which must be lowered from a surface vessel or platform to the ocean floor. One method uses a long string of pipe lowered from a ship with the mining apparatus suspended from the lower end of the pipe. To support the heavy mining equipment a very heavy walled pipe is required. Thus, the pipe itself becomes a major factor in the total weight and very special equipment must be provided for handling the extremely heavy sections of pipe. For example, in one deep ocean mining ship, 60 foot long stands of pipe are used, each of which weighs from 30,000 to 40,000 pounds.

These heavy pieces of pipe must be handled on board a ship which is subject to pitching and rolling, as well as heave. It is essential for safety of personnel and structural integrity of the vessel and its associated equipment that the pipe be firmly constrained at all times.

In such a mining ship the pipe may be stored horizontally in special holds below deck. From there it must be brought to the deck and elevated onto a derrick platform from which it is lowered into the sea. The derrick has a travelling block that grips the upper end of a pipe and raises it towards a vertical position. As this occurs it is desirable to grip the lower end of the pipe and assure that it is brought into alignment with an existing pipe string beneath the derrick. Because of the massive weights manual labor would be unsatisfactory and a mechanism must be used for guiding and centering the lower end of the pipe. It is of some importance that damage to the exterior of the pipe is avoided. The same equipment must also move the lower end of the pipe laterally to be carried to the horizontal racker as it is removed from a pipe string.

BRIEF SUMMARY OF THE INVENTION

There is, therefore, provided in practice of this invention according to a presently preferred embodiment an automatic roughneck for handling the lower end of a pipe during a portion of its travel between a more nearly horizontal storage position and a vertical use position. The machine has a pair of opposed jaws traversable in a generally horizontal direction between a center line position wherein a pipe is in a vertical position for use and a lateral position wherein a pipe is tilted for transportation to or from the storage system. The jaws are opened into a generally U-shaped opening facing towards the lateral position for receiving a pipe and constraining it from uncontrolled lateral movement towards the center line position. When the jaws approach the center line position they are closed into a generally O-shaped opening for holding the pipe. Thereafter the jaws are opened into a generally U-shaped opening facing in the opposite direction for clearing a pipe in the center line position.

In particular, the automatic roughneck has a pair of tracks each having a trolley with a pipe jaw pivotally mounted thereon. The two trolleys move along the track in synchronism and pivoting of the jaws is controlled by cams on the tracks engaging rollers on the jaws. A movable segment of track permits the jaws to open for clearing the pipe. During operation of the automatic roughneck a stand of pipe is delivered to it by a pipe handling cart that travels on an inclined conveyor. A hoisting elevator lifts the upper end of the pipe up a derrick. At this point the automatic roughneck jaws are opened towards the pipe and the trolleys move away from the center line position to engage the pipe and lift it from the transfer cart. The cart returns down the inclined conveyor to receive another stand of pipe.

Once the cart is clear the automatic roughneck trolleys reverse direction and guide the lower end of the pipe towards the center line position. Simultaneous with this motion the elevator continues to raise the pipe in the derrick. As the trolleys move towards the center line position, rollers on the jaws contact cams on the track causing the jaws to close around the pipe. The trolleys continue to move along the tracks until centered over an existing pipe string. Thereupon, the elevator lowers the pipe to be joined to an existing pipe string beneath the derrick. Once engagement has been made the movable segment of track is retracted so that the jaws open in the opposite direction to clear the pipe and permit the trolleys to proceed towards the lateral end of the tracks to pick up the next stand of pipe. Removal of pipe from a pipe string involves the reverse operation.

DRAWINGS

These and other features and advantages of the present invention will be appreciated as the same becomes better understood by reference to the following detailed description of a presently preferred embodiment when considered in connection with the accompanying drawings wherein.

DESCRIPTION

Figure 1:
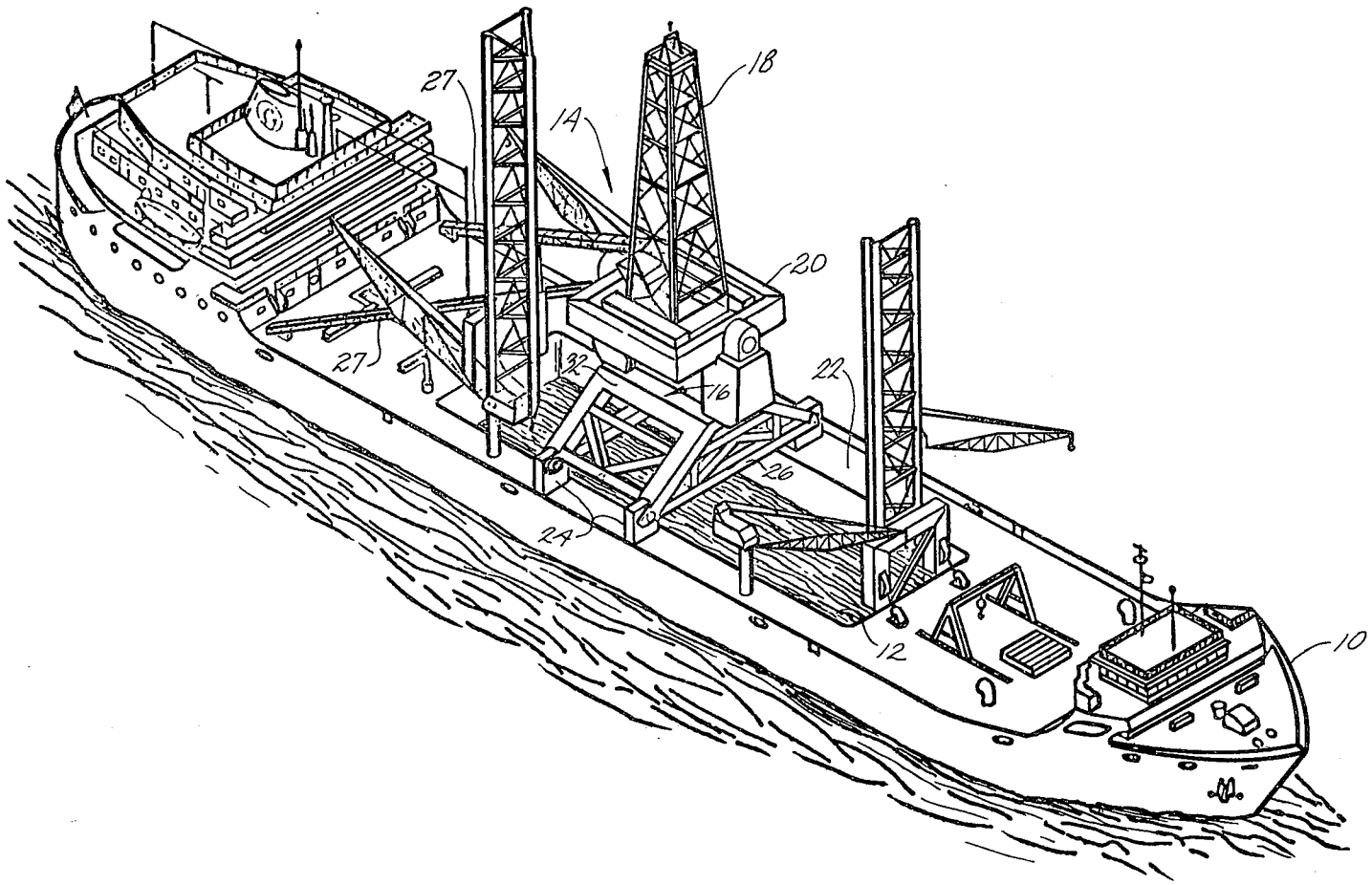
FIG. 1 is a perspective view of a deep ocean mining ship.

FIG. 1 illustrates in perspective a deep ocean mining ship 10 on which an automatic roughneck as provided in practice of this invention is particularly useful. The ship has a large center well or "moon pool" 12 located amidships which gives access to the water and the ocean floor from the deck of the ship. Sub sea mining equipment (not shown) is stored in the large opening of the moon pool during transit and on reaching the mining site is lowered from the center well 12 to the ocean floor by a string of pipe which is assembled in sections and lowered by a pipe handling system indicated generally by reference numeral 14. The pipe handling system includes a heavy A-frame base 16 which bridges the center well 12 amidship of the vessel 10. A hoisting derrick 18 is supported over the center well on the A-frame 16 through a double gimbal system 20 which permits the derrick to maintain a vertical position even though the ship may be rolling or pitching beneath it.

The A-frame 16 is supported from the main deck 22 of the ship by four support pedestals 24. The A-frame support structure 16 includes a pair of end trusses 26 which bridge the center well between the support pedestals. The trusses 26 are tied together by horizontal girders 32 near the top of the trusses, the girders 32 being spaced apart to leave an opening through which a lower end of the derrick structure 18 extends. This lower structure which is hidden in FIG. 1 includes a hydraulic heavy lift system for handling the extreme weights of the pipe string and subsea mining equipment suspended through the center well. The ship gimbal support for the pipe handling system and heavy duty hoisting mechanisms do not per se form a portion of this invention and no additional description is required herein.

Figure 2:
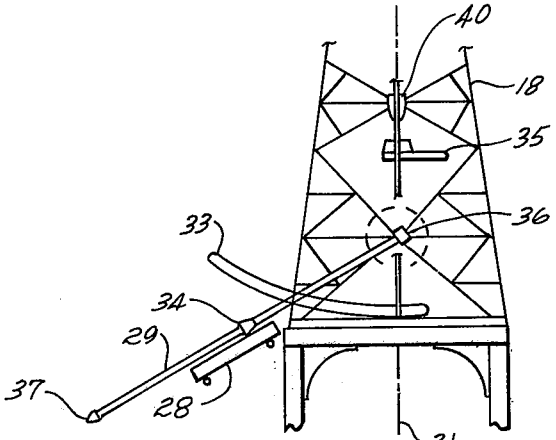
FIG. 2 illustrates schematically the hoisting arrangement for pipe indicating location of the automatic roughneck within a derrick.

Pipe for support of the mining equipment is stored in 60 foot lengths beneath the deck of the ship. It is raised to deck level and positioned on an inclined conveyor 27 which carries the pipe upwardly and laterally to the rig floor which supports the derrick 18. This arrangement is also illustrated schematically in FIG. 2 wherein a cart 28 carries a stand of pipe 29 at an angle from horizontal until the upper end of the pipe reaches the center line 31 of the pipe handling system, that is, over the center line of an existing pipe string. Before reaching this position the end of the pipe passes between the tracks of an automatic roughneck 33 described in greater detail hereinafter. When the end of the pipe reaches the center line 31 of the derrick 18 and associated lifting equipment, the upper end is gripped by an elevator unit 35 and elevated up into the derrick by a travelling block 40. This swings the pipe towards a more vertical position with its lower end still supported by the cart 28. As the pipe is lifted its center portion rises relative to the cart 28 which continues to support the pipe progressively nearer its lower end. The automatic roughneck then lifts the pipe off of the cart by swinging the lower end laterally, thereby permitting the cart to return down the conveyor 27. As the pipe approaches its vertical position, but while it is still inclined, it is constrained from swinging towards the vertical position by the automatic roughneck.

It will be noted that the stand of pipe is formed of two 30 foot lengths of pipe having a pipe joint 34 in the middle. A female threaded box 36 is provided at the upper end of each length of pipe and a male threaded pin 37 is provided at the lower end. Thus, when the pipe is in its vertical position on the center line of the derrick it can be lowered so that the pin is "stabbed" into a box on an adjacent length of pipe being lowered into the sea. The threaded joint is then tightened and the weight of the pipe string beneath the ship can then be supported by the new section just added. In this manner the length of pipe being lowered into the sea is continually increased. Conversely when the mining equipment is being raised alternate threaded joints in the pipe string are unscrewed and double lengths of pipe are removed and carried to the hold of the ship in a manner exactly opposite to that used during lowering of the pipe.

Figure 3:
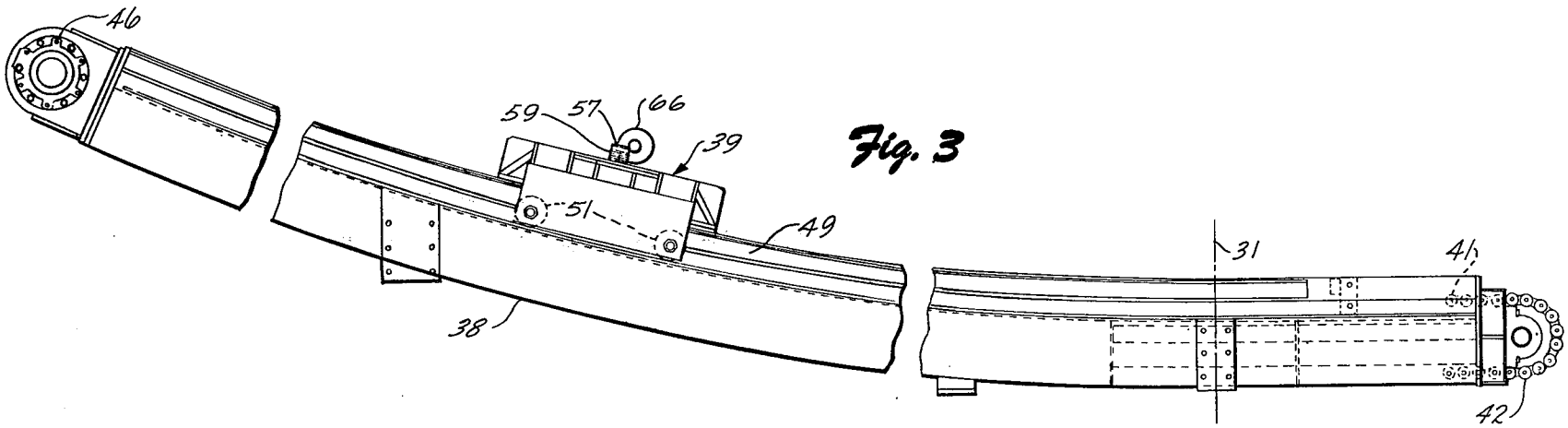
FIG. 3 is a side view of the automatic roughneck.

The automatic roughneck 33 handles the lower end of the pipe as it is being moved from the tilted position clearing the cart with the lower end near the edge of the rig floor to a substantially vertical position with the pipe on the center line of the derrick. The mechanism for controlling the path of the pipe during this swing is illustrated in side and top views in FIGS. 3 and 4, respectively.

The automatic roughneck has a pair of parallel tracks 38 which are curved in a vertical plane so as to be horizontal at the end adjacent the center line 31 of the pipe handling system and suspended pipe string and inclined from horizontal at the end extending laterally towards the pipe being supplied to the derrick. A pair of carts or trolleys 39 are mounted on the respective tracks (one trolley per track) for travel along the length thereof. Each trolley is connected to a continuous pitch chain or roller chain 41 which passes over an idler sprocket 42 at the center line end of the roughneck track. Each roller chain passes over a drive sprocket 43 at the lateral end of the track and the two drive sprockets are interconnected by a shaft 44 driven by electric or hydraulic motors 46. Since the two drive sprockets are linked together by the common shaft 44 the two trolleys are driven in synchronism and in effect operate as a single trolley travelling along tracks.

Figure 6:
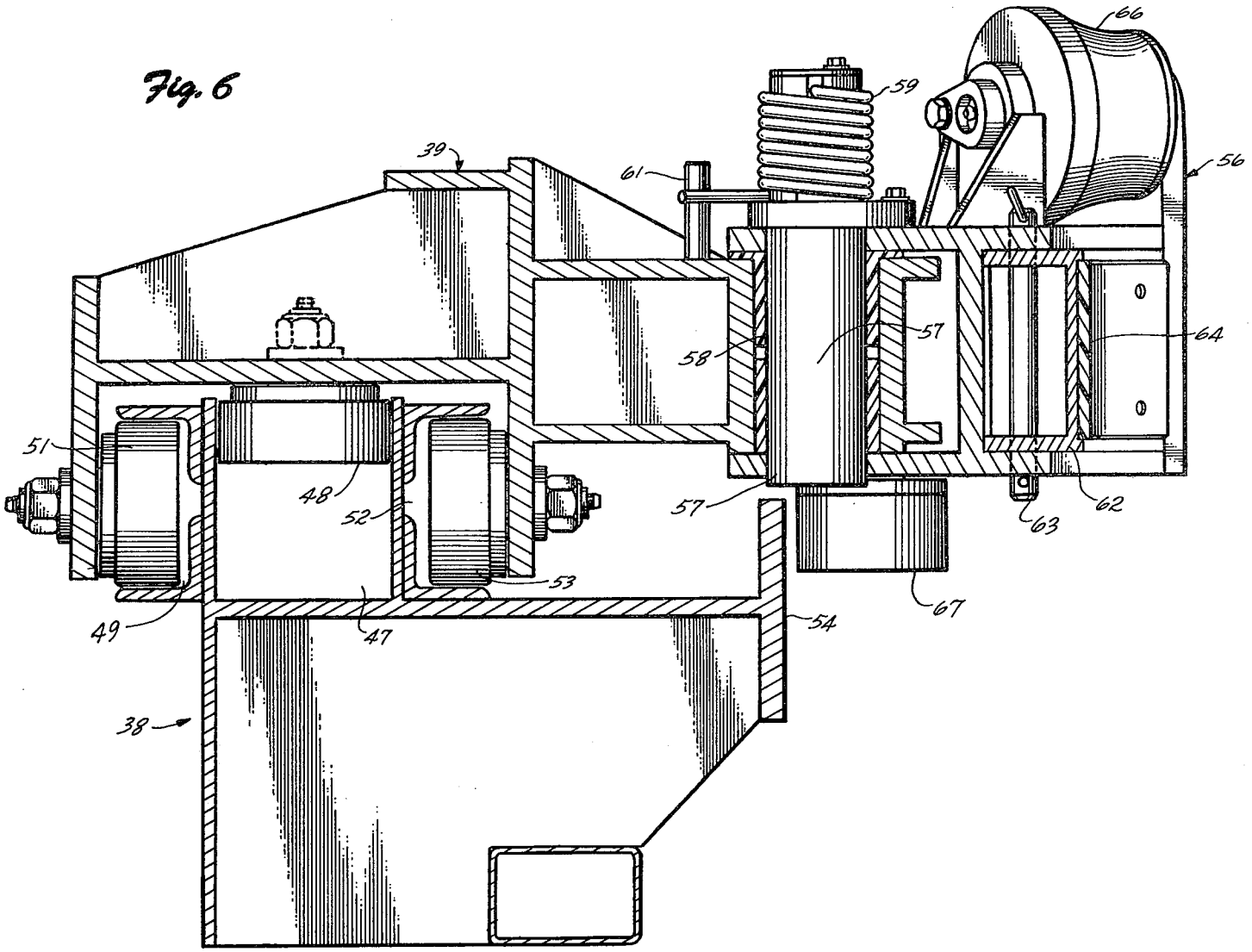
FIG. 6 is a transverse cross section of a portion of the track and pipe handling trolley.

FIG. 6 illustrates in transverse cross section one of the carts 39 and a portion of a track 38. The track has an upwardly facing channel 47 in which a pair of rollers 48 on the trolley are free to roll and guide the trolley along the track. Each track also has an outwardly facing channel 49 in which a pair of rollers 51 ride and an inwardly facing channel 52 in which a pair of rollers 53 are free to roll. The rollers 51 and 53, being constrained within their respective channels, carry vertical loads imposed by the trolley cart. The combination of six rollers keeps the trolley closely aligned with the track and permits it to travel freely along the length of the track. Each track also has a guide rail 54 along its inner edge.

A jaw 56 which constrains the pipe stand being added to the string, is mounted on each trolley 39 by a heavy pivot pin 57. A bushing 58 permits free pivoting of the jaw relative to the trolley. A heavy torsion spring 59 has one end engaging the pivot pin 57 and another end engaging an upstanding post 61 on the main structure of the trolley.

Each jaw has an insert 62 removably connected to the jaw by mounting pins 63. The insert has a low friction facing 64 such as "Teflon" TFE or FEP. The low friction facing has some resiliency so that when it engages a pipe there is little possibility of damage to the pipe. Since different diameter pipes are used for different portions of the length of the pipe string, the inserts are readily replaceable so that each different pipe diameter is as closely confined as possible.

A roller 66 is mounted on the top of the jaw 56 for rotation about a horizontal axis. The roller also has a composition face so that when it engages a piece of pipe it will not cause damage to the pipe.

A pair of guide rollers 67 and 68 (FIGS. 4 and 5) are mounted on the under side of the jaw for engaging the rail 54 of the track.

Figure 7:
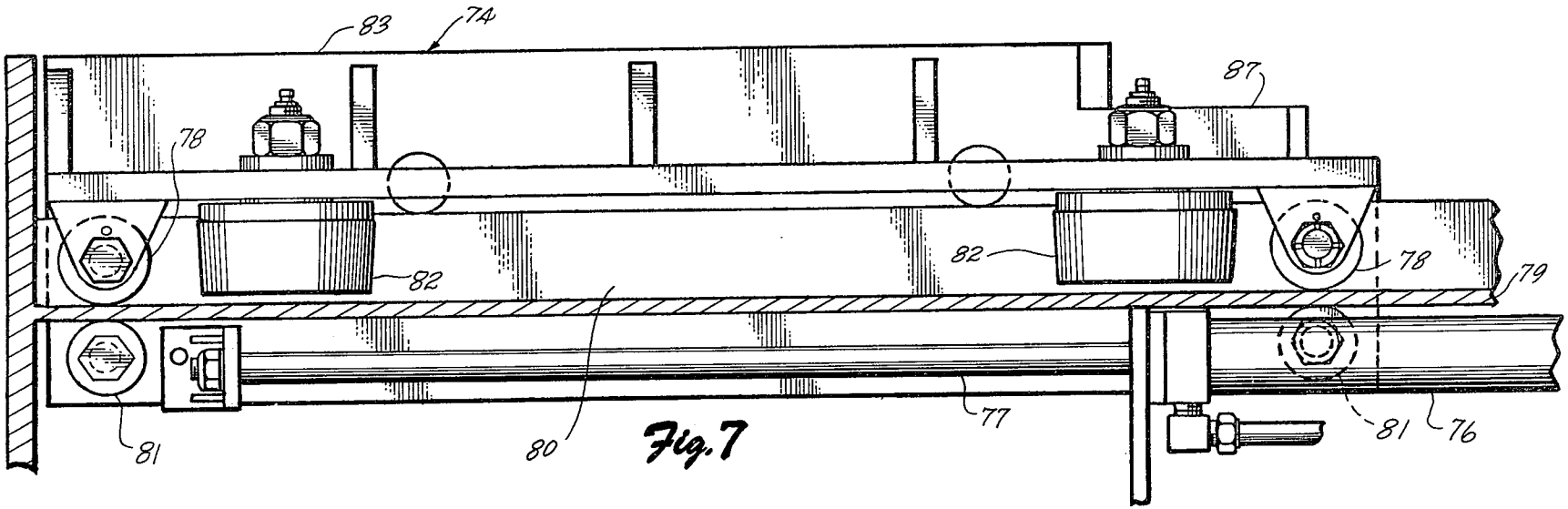
FIG. 7 is a fragmentary detail of a sliding segment of the automatic roughneck track.
Figure 4:
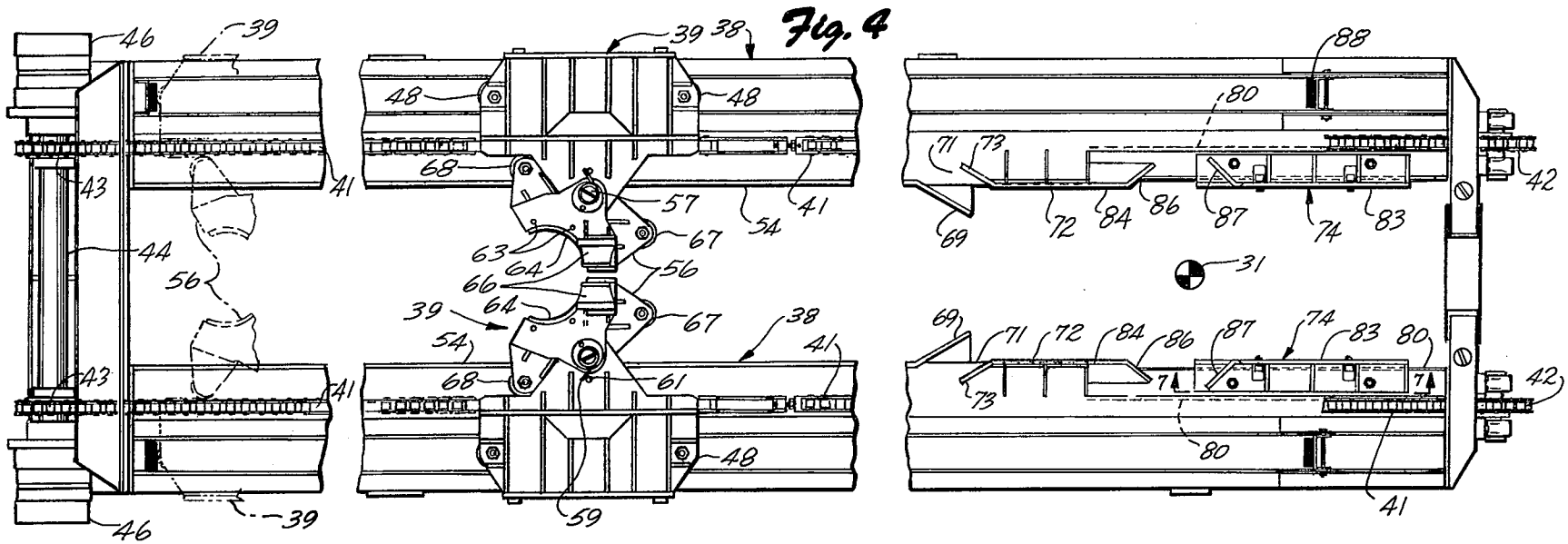
FIG. 4 is a top view of the automatic roughneck.
Figure 5:
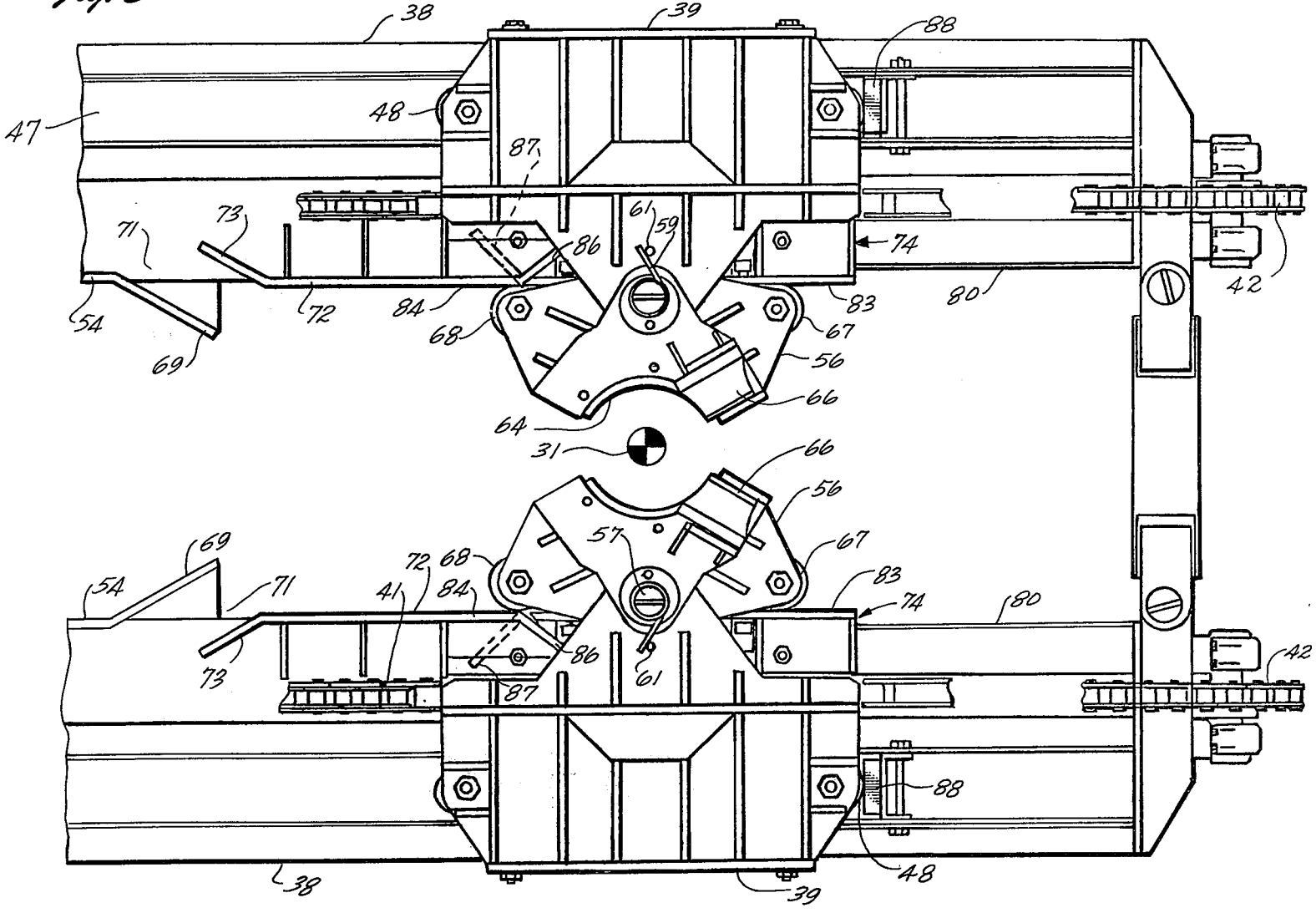
FIG. 5 is another top view of a portion of the automatic roughneck with its pipe handling trolley in a different position.

The inboard guide rail 54, as seen in FIGS. 4 and 5, extends along a principal portion of the track from the lateral end towards the center line end. The guide rail ends in a cam 69 that extends inwardly. There is then a short gap 71 between the guide rail 54 and a centering rail 72. A camming ramp 73 on the centering rail extends outwardly into the space behind the guide rail 54. A sliding rail assembly 74 is mounted on each track on its inboard side near its center line end. The sliding rail assemblies are movable longitudinally along the track in the same directions as the trolleys. In FIG. 4 the sliding rail assemblies are illustrated in an arbitrary intermediate position a short distance away from the center line end of the tracks. In FIG. 5 the sliding rail assemblies are shown in their extended position nearest the center line of the pipe. In FIG. 7, which is an inwardly looking side view of the sliding rail assembly, the assembly is in its fully retracted position at the end of the track. A hydraulic cylinder 76 (FIG. 7) is mounted on the under side of the track and its piston rod 77 is connected to the sliding rail assembly. The sliding rail assembly has a pair of support rollers 78 which bear on a web 79 of the track. A second pair of rollers 81 below the web 79 help guide the sliding segment of the track. A pair of large rollers 82 rotatable about a vertical axis bear on a web 80 (FIG. 4) on the track for conveying loads from the sliding rail assembly to the principal portion of the track. The assembly also has a rail segment 83 that, when the sliding rail assembly is in its center line position, is an extension of the centering rail 72 for maintaining the jaws in their centered position around the pipe.

The centering rail has an upper extension 84 and an outwardly directed cam 86. The sliding rail segment 83 has a lower cam 87, also extending outwardly. The upper extension 84 and cam 86 fit over the lower cam 87 so that when the sliding rail assembly is in its extended position as in FIG. 5 there is an overlap and the centering rail 72 and sliding rail segment 83 form an essentially continuous surface.

As seen in FIG. 5, when the trolleys are in the position adjacent the center line 31 the jaws 56 are in a closed position leaving an O-shaped opening which has a diameter substantially the same as that of a pipe to be centered and guided by the jaws. The guide rollers 67 and 68 are against the centering rail 72 and sliding rail 83 and hence are aligned along the length of the apparatus. It will be noted that the centering rail and sliding rail segment are spaced so that both rollers 67 and 68 are in engagement so that the jaws are forced towards each other and the pipe is securely positioned on the center line. Because of the composition facing 64 on the jaws, vertical motion of the pipe relative to the jaws can be accommodated without damage to the pipe or guide surfaces. Such motion is of course limited to the region between the pipe joints.

During raising of the pipe string, once a length of pipe has been elevated to a point where it is disconnected from the balance of the pipe string the two trolleys are moved laterally towards the lateral end of the automatic roughneck. The roller chains 41, driven by the motors 46 pull the trolleys towards the lateral end of the tracks. Since the jaws close around the pipe it is carried along with the trolleys. When the rollers 68 on the jaws come to the respective gaps 71 between the centering rail and guide rail they are forced outwardly by the camming surface 69. The roller 68 thus rides along the outboard side of the rail 54 as illustrated in FIG. 4. This camming causes the entire jaw to pivot around the pin 57 so that the rollers 66 on the two jaws are in close proximity and substantially coaxial. This opens up the jaws to form a U-shaped opening facing towards the lateral end of the roughneck so that the pipe is constrained from swinging towards the center line position. It will be recalled that the upper end of the pipe is supported on the center line of the derrick by the elevator 35. The weight of the suspended pipe holds it in tight engagement with the rollers 66 when the lower end is swung laterally from the center line. The great weight of the pipe keeps it swung tightly against the rollers and there is no tendency for it to come out of the U-shaped opening formed by the two jaws. While the trolleys are being drawn laterally the pipe is also being lowered and rides on the rollers 66 until the center can be picked up by a cart 28 (FIG. 2) on the inclined pipe conveyor. Once this cart has picked up the weight of the pipe, the trolleys 39 on the automatic roughneck can be retracted away from the section of pipe being conveyed.

When pipe is being lowered from the ship the operation is just the reverse. The upper end of the pipe passes between the tracks and is picked up by the elevator above the center line of the automatic roughneck. The trolleys are moved laterally until the segment of pipe below the intermediate joint 34 is engaged by the rollers 66 and the weight of the pipe is lifted off the cart 28 on the inclined conveyor. The cart is moved down the conveyor. The trolleys 39 can then be moved towards the center line of the automatic roughneck. Meanwhile the pipe is being further elevated in the derrick. When the trolleys approach the center line, the rollers 68 engage the cams 73 and the roller moves through the gap 71 between the guide rail and the centering rail. This swings the jaw into a position wherein the pipe is rather closely gripped and precisely centered on the center line of the apparatus. It will be noted that the pipe moves vertically in the handling system while held by the jaws. They are, therefore, not tightly closed so that the motion can be accommodated.

It is desirable in raising or lowering mining equipment to move the pipe continuously so that the inertial forces of stopping and starting are avoided. This means that once a stand of pipe has been stabbed into the lowering pipe string the trolleys must return to the lateral end of the roughneck to pick up the next piece of pipe and bring it to the center line in time to stab into the moving pipe string. Means are therefore provided for opening the jaws into a U-shaped opening facing away from the lateral end of the roughneck to clear the pipe.

This is accomplished by retracting the sliding rail assemblies 74 towards their position at the end of the track. The torsion spring 59 between the trolley and jaw 56 continually urges the jaw towards a position with a U-shaped opening facing away from the lateral end of the roughneck, that is the jaw is biased in a direction that urges the roller 67 towards the rail. When the sliding rail assembly retracts, the roller 67 can pass down the cam 87 on the sliding rail segment, thereby pivoting the jaw around the pin 57 and creating a U-shaped opening facing away from the lateral end of the roughneck. When the trolleys are moved in a direction towards the lateral end of the roughneck, the jaws thus clear a pipe on the center line position. The jaws are cammed back to a position parallel to the rails by the roller 67 running up the cam 86 on the centering rail.

The jaws have generally C-shaped openings aligned with each other when the two trolleys are in the center line position and the jaws are held in parallelism by the centering rail 72 and sliding rail 83. This defines an O-shaped opening as seen in FIG. 5. When the jaws are pivoted in one direction with the rollers 68 on the outside of the respective rails 54 the C-shaped openings of the jaws cooperate to define the U-shaped opening facing in the lateral direction as seen in FIG. 4 so that the pipe is supported. When the jaws are pivoted in the opposite direction upon retraction of the sliding rail assemblies 74 the C-shaped portions cooperate to define a U-shaped opening in the opposite direction for clearing the pipe. It will be noted that when the sliding rail assemblies are retracted with the trolleys in their center line position holding a piece of pipe, the jaws are constrained from pivoting by interference between the facing 64 and the side of the pipe. It is only when the trolleys are moved towards the lateral position that the rollers 67 move into the gas between the centering rail and sliding rail segment.

When mining equipment is being raised and the automatic roughneck is being used for returning pipe to storage a reverse operation is conducted. In that operation when the trolleys approach the center line position the rollers 67 move into the gap between the centering rail and sliding rail to permit the jaws to clear the pipe. When the trolleys reach the center line position the facings 64 engage the sides of the pipe and swing the jaws towards the centered position. Extension of the sliding rail assemblies causes the cam 87 to engage the roller 67 and assure that the jaws are substantially parallel to define the O-shaped opening.

It will be noted that operation of the jaws for constraining a pipe from lateral motion and for centering it on the center line of the apparatus are controlled by the position of the trolleys on the track and no separate control by an operator is required. All the operator need do is control position of the trolleys along the track by manipulating the drive motors 46. Cocking of the jaws toward the lateral end of the track occurs automatically when the trolley reaches the gap in the rail. The only other control required is for opening the jaws to clear a pipe, and this is done at a noncritical moment simply by retracting the sliding rail segment. This permits cocking of the jaws in the opposite direction. The position of the trolleys adjacent the center line of the pipe handling system is assured by a pair of bumpers 88 which limit travel of the trolley and assure positioning adjacent the center line. With such absolutely simple control, automatic rather than manual controllers may easily be provided.

Although but one embodiment of automatic roughneck constructed according to principles of this invention has been described and illustrated herein, many modifications and variations will be apparent to one skilled in the art. Thus, for example, instead of using a cylindrical bushing in the jaws for positioning the pipe on the center line, two or more rollers may be mounted on each jaw to collectively form either an O-shaped opening for centering or a U-shaped opening for guiding and constraining the pipe. Many other modifications and variations will be apparent to one skilled in the art and it is therefore to be understood that within the scope of the appended claims the invention may be practiced otherwise than as specifically described.

What is claimed is:

1. An apparatus for handling the lower end of a pipe during a portion of its travel between a horizontal storage position and a vertical use position comprising:

a pair of opposed jaws;

means for traversing the jaws in a generally horizontal direction between a center line position wherein a pipe is vertical for use and a lateral position wherein a pipe is tilted for transportation to or from storage the means for traversing including a pair of parallel tracks, means for mounting one of the jaws on each track, and means for traversing the jaws along the respective tracks in synchronism with each other;

means for opening the jaws into a generally U-shaped opening facing towards the lateral position for receiving a pipe in the opening and constraining it from uncontrolled lateral movement towards the center line position;

means for closing the jaws into a generally O-shaped opening adjacent the center line position for holding the pipe; and means for opening the jaws into a generally U-shaped opening facing away from the lateral position adjacent the center line position for clearing a pipe located in the center line position.

2. An apparatus as defined in claim 1 wherein the means for mounting comprises a trolley mounted on each track for movement along the length thereof and wherein each jaw is movably mounted on a respective trolley; and further comprising means on the track for moving the jaws in response to movement of the trolleys along the track.

3. An apparatus as defined in claim 2 wherein the tracks are curved in a vertical plane and are substantially horizontal adjacent the center line position and tilted relative to the horizontal adjacent the lateral position.

4. An apparatus as defined in claim 2 wherein each jaw includes a roller mounted on the jaw for rotation about an axis transverse to a length of pipe for engaging the pipe surface, said rollers being substantially coaxial when the jaws are opened into the generally U-shaped opening facing towards the lateral position.

5. An apparatus as defined in claim 1 wherein the means for traversing comprises a trolley on each track and each jaw is mounted on a respective trolley for pivoting about an axis transverse to the track; and wherein each track includes a guide rail extending along the length thereof; and each jaw includes a camming member for engaging the guide rail and pivoting the jaw between the O-shaped opening and the U-shaped opening facing towards the lateral position.

6. An apparatus as defined in claim 5 wherein the means for opening the jaws into the U-shaped opening facing away from the lateral position comprises:

means for urging the jaws towards said U-shaped opening and means for moving a segment of rail between a first position preventing opening and a second position permitting opening.

7. An automatic roughneck for guiding the lower end of an elevated pipe in a substantially horizontal direction between a lateral position wherein the pipe extends in a sloping direction and a center line position wherein the pipe extends in a substantially vertical direction without changing the elevation comprising:

a generally horizontally extending pair of tracks extending on either side of the center line position;

a pair of trolley means separately supported on each of the respective tracks for engaging and traversing along the tracks with the lower end of the pipe;

means on the trolley means for guiding the pipe adjacent the lateral position and preventing the lower end from uncontrollably swinging towards the center line position;

means on the trolley means for constraining the pipe from lateral movement in any direction when adjacent the center line position; and means for releasing the pipe constraining means from the pipe adjacent the center line position to permit the trolley means to be moved past the pipe when in the center line position.

8. An automatic roughneck as defined in claim 7 wherein the means for guiding includes means for accommodating vertical movement of the pipe relative thereto.

9. An automatic roughneck as defined in claim 7 wherein the track comprises a pair of parallel spaced apart tracks, and wherein the trolley means comprises a pair of trolleys each on a respective track, and further comprising:

drive means for traversing the two trolley means along the respective tracks in synchronism with each other.

10. An automatic roughneck as defined in claim 7 wherein each trolley means comprises:

a jaw; and means for mounting the jaw on the trolley for pivoting about an axis transverse to the respective track between a central position and a cocked position on each side of the central position;

each jaw including pipe engaging portions on each side thereof that, when centered both engage a pipe, and when pivoted in either direction around the pivot axis one portion clears the pipe and the other portion is sufficiently near the opposite jaw to engage a pipe.

11. An automatic roughneck as defined in claim 7 wherein each trolley means includes a jaw;

means for mounting the jaw on the trolley means for pivoting about an axis transverse to the track;

a camming member on the jaw on each side of the pivot axis in directions extending along the length of the track; and a pipe engaging portion on each jaw, said pipe engaging portions on the two jaws collectively defining a generally O-shaped opening when the jaws are centered on the center line position.

12. An automatic roughneck as defined in claim 11 further comprising:

cam means on each track for engaging one of the camming members and pivoting the respective jaw between the generally O-shaped position and a position wherein the two jaws collectively define a generally U-shaped opening between the jaws facing towards the lateral position.

13. An automatic roughneck as defined in claim 12 wherein the means for releasing the pipe restraining means comprises a movable segment of track engaging the other of the camming members on the jaw for permitting pivoting of the respective jaw for defining a generally U-shaped opening between the jaws facing away from the lateral position.

14. An automatic roughneck for guiding the lower end of an elevated pipe in a substantially horizontal direction between a lateral position wherein the pipe extends in a sloping direction and a center line position wherein the pipe extends in a substantially vertical direction without changing the elevation comprising:

a pair of parallel tracks positioned on either side of said center line position;

a separate trolley on each track;

means for moving the separate trolleys along the respective tracks on synchronism with each other; and jaw means on each trolley for cooperating with like jaw means on the other trolley, for a. rotatably securing the lower end of a pipe in the center line position, b. moving the pipe between the tracks in the lateral direction with the trolley means from the sloping position to the vertical position; and alternatively c. clearing the pipe in the center line position for moving the trolleys back towards the lateral direction without the pipe.

15. An automatic roughneck as defined in claim 14 wherein the jaw means comprises:

a generally C-shaped jaw; and means for mounting the jaw on the trolley for pivoting about a substantially vertical axis; and further comprising:

means on the tracks for pivoting the jaws in response to movement of the trolleys along the tracks.

16. An automatic roughneck as defined in claim 15 wherein each jaw includes a camming roller on each side of the pivot axis and wherein the means for pivoting the jaw comprises:

a centering rail on each track adjacent the center line position for engaging both camming rollers on the respective jaw and centering the jaws;

a cam on each track for engaging one of the camming rollers on the respective track for pivoting the jaws relatively outwardly at their ends facing towards their lateral position; and a sliding rail segment for alternatively preventing and permitting pivoting of the jaws relatively outwardly at the ends facing away from the lateral position.

17. An automatic roughneck as defined in claim 16 further comprising a guide rail adjacent the cam for engaging the one camming roller and preventing pivoting of the jaw towards its centered position.

* * * * *